US010713912B2

(12) United States Patent
Wagner

(10) Patent No.: US 10,713,912 B2
(45) Date of Patent: Jul. 14, 2020

(54) ACCESS-MONITORING DEVICE WITH AT LEAST ONE VIDEO UNIT

(75) Inventor: Philippe Wagner, Basel (CH)

(73) Assignee: INVENTIO AG, Hergiswil NW (CH)

( * ) Notice: Subject to any disclaimer, the term of this patent is extended or adjusted under 35 U.S.C. 154(b) by 179 days.

(21) Appl. No.: 14/007,984

(22) PCT Filed: Mar. 26, 2012

(86) PCT No.: PCT/EP2012/055342
§ 371 (c)(1),
(2), (4) Date: Oct. 14, 2013

(87) PCT Pub. No.: WO2012/130808
PCT Pub. Date: Oct. 4, 2012

(65) Prior Publication Data

US 2014/0036086 A1 Feb. 6, 2014

(30) Foreign Application Priority Data

Mar. 28, 2011 (EP) ..... 11159995

(51) Int. Cl.
*G08B 13/196* (2006.01)
*B66B 5/00* (2006.01)
*B66B 1/46* (2006.01)

(52) U.S. Cl.
CPC ..... *G08B 13/19613* (2013.01); *B66B 1/468* (2013.01); *B66B 5/0031* (2013.01)

(58) Field of Classification Search
CPC ..... B66B 5/0012; B66B 5/0031; B66B 1/468; B66B 5/0006; B66B 3/00; B66B 3/002;
(Continued)

(56) References Cited

U.S. PATENT DOCUMENTS 5,954,933 A * 9/1999 Ingalls ..... B03C 1/30 204/557
7,581,622 B2 * 9/2009 Amano ..... B66B 1/18 187/384

(Continued)

FOREIGN PATENT DOCUMENTS

EP 1475754 A1 11/2004
EP 2402275 A1 1/2012

(Continued)

*Primary Examiner* — Mohammed Jebari
(74) *Attorney, Agent, or Firm* — William J. Clemens; Shumaker, Loop & Kendrick, LLP

(57) ABSTRACT

An access-monitoring device of an elevator installation includes at least one video unit, wherein the video unit is connected to a control unit via a communications network. The video unit records at least one image of a defined monitoring space of the access-monitoring device. The video unit filters out a non-changing part of the at least one image and evaluates the remaining image part as to whether there is an object in the monitoring space. In the case of there being an object in the monitoring space, the video unit communicates data to the control unit. The control unit checks, in dependence on the data communicated, the authorization of the object in the monitoring space and determines either the direction of movement or the location of the object within the monitoring space.

14 Claims, 3 Drawing Sheets

(58) Field of Classification Search
CPC ..... B66B 3/004; B66B 3/006; B66B 3/008; B66B 5/00; B66B 5/0018; B66B 5/021; H04N 7/181; H04N 5/247; H04N 5/23219; H04N 5/23296; H04N 5/23206; G06K 9/00228; G06K 9/209; G08B 13/19613; G08B 13/19641; G08B 13/19673; G08B 13/19693; G08B 13/19695
See application file for complete search history.

(56) References Cited

U.S. PATENT DOCUMENTS 8,061,485 B2 * 11/2011 Finschi ..... 187/384
2003/0185419 A1 * 10/2003 Sumitomo ..... 382/103
2005/0138385 A1 * 6/2005 Friedli ..... B66B 1/468 713/182
2005/0168574 A1 8/2005 Lipton et al.
2005/0205668 A1 * 9/2005 Sogo ..... G07C 9/00087 235/382
2005/0225634 A1 * 10/2005 Brunetti et al. ..... 348/143
2006/0037818 A1 * 2/2006 Deplazes et al. ..... 187/392
2007/0122011 A1 * 5/2007 Takizawa ..... G07C 9/00158 382/118
2007/0189585 A1 * 8/2007 Sukegawa ..... G06K 9/00221 382/118
2007/0272493 A1 * 11/2007 Legez ..... 187/313
2008/0158358 A1 * 7/2008 Chanson ..... B60R 25/102 348/148
2009/0208067 A1 8/2009 Peng et al.
2009/0294704 A1 * 12/2009 Zailer ..... H01Q 3/46 250/580
2010/0157049 A1 * 6/2010 Dvir et al. ..... 348/143
2010/0332648 A1 * 12/2010 Bohus ..... G06Q 10/10 709/224
2011/0007139 A1 * 1/2011 Brunetti ..... G08B 13/19613 348/51
2011/0048865 A1 * 3/2011 Flynn ..... B66B 1/468 187/384
2012/0160613 A1 * 6/2012 Friedli ..... 187/384
2012/0200711 A1 * 8/2012 Dolin ..... H04N 7/181 348/159
2013/0037138 A1 * 2/2013 Georis ..... F01N 3/2066 137/551

FOREIGN PATENT DOCUMENTS

JP 2002046950 A 2/2002
JP 2007230733 A 9/2007
JP 2009015412 A * 1/2009
KR 20040087079 A * 10/2004

* cited by examiner

ACCESS-MONITORING DEVICE WITH AT LEAST ONE VIDEO UNIT

FIELD

The invention relates to an access monitoring device of an elevator installation with at least one video unit, wherein the at least one video unit is connected with a control unit by way of a communications network.

BACKGROUND

In some buildings an access control is necessary so as to be able to prevent specific parts of the building from being publicly accessible. In many buildings this access control is to be found at the entrance of the building. However, many larger buildings, for example office buildings, shopping centers, apartment buildings, etc., have building parts which also have to be accessible to the public, while other building parts are to be accessed only by specific persons, for example because a higher level of security has to apply to these building parts. Thus, for example, the ground floor of a building can be accessible to the general public, but the upper floors are private and shall not be made accessible to the general public or shall be made accessible only under specific preconditions.

The European patent application with the application number 10167984.3 describes an elevator security control system for an elevator system comprising at least one elevator car. The system comprises an access monitoring device which detects an unauthorized individual within a defined region and issues a signal. The issued signal is used for the purpose of blocking use of the elevator system.

In order to restrict the access the individual floors use of elevator installations installed in the building can be restricted. In that case, for example, it can be sought that unauthorized persons can reach and use the elevator installation by means of barriers, double-door systems, access controls, turnstiles, security personnel, etc. Devices of that kind can be termed access monitoring device or access control device.

Barriers, double-door systems, access controls, turnstiles, etc., are usually regarded by building owners, architects, users, etc., as too awkward and unaesthetic. Thereagainst, smaller, minimalized access monitoring devices are frequently of reduced effectiveness and easy to overcome. An object of the invention is to propose a cost-effective and efficient access monitoring device.

SUMMARY

The core of the invention consists in that the presence of an object in a defined monitoring space of the access monitoring device is detected with the help of at least one video unit in an access monitoring device of an elevator installation and the direction of movement or the location of the object within the monitoring space is ascertained by detected data or an evaluation result determined by the at least one video unit. Moreover, the authorization of the object can be checked in dependence on the ascertained data.

The access monitoring device, for example a barrier, double-door system, a virtual line or barrier area, etc., of an elevator installation serves the purpose of preventing or hindering access of unauthorized objects, for example persons, visitors, animals, etc., to an elevator installation. For that purposes it comprises at least one video unit which is connected with a control unit by way of a communications network. The communications network employed can be of any kind. Thus, for example, use could be made of a wire-connected, a non-wire-connected or a radio communications network. The control unit can be integrated in the video unit or represent a separate unit. It is also conceivable for the control unit to represent a sub-function of the elevator control unit of the elevator installation, thus the control unit being integrated in the elevator control unit.

The at least one video unit records at least one image from a defined monitoring space of the access monitoring device. The monitoring device can be, for example, a double-door system of the passageway. The foreground area of the access monitoring device could also be defined as monitoring space. The monitoring space can also be defined in the form of a virtual monitoring area in a building.

Any desired analog or digital video unit can be used as the at least one video unit and can, for example, be a proprietary monitoring camera, a video camera, etc. The at least one video unit comprises at least one image recording unit and image processing unit or (integrated) control unit for at least partial image processing. The at least one video unit can also be connected with the (external) control unit by way of the communications network. A processor, a computer, a proprietary computer or server with proprietary components and, for example, with a memory unit can be used as the control unit. The image processing is carried out by the control unit, in integrated or external form. In that case use is made of suitable algorithms and methods. According to the invention it is possible that either the entire image processing is performed in the at least one video unit or in the (external) control unit connected by way of the communications network. However, an only partial image processing in the integrated control unit and a final image processing in the (external) control unit connected by way of the communications network is also conceivable.

An unchanging image part is filtered out of the at least one image. This can be, for example, the background, a non-moving object, etc. Overall, the image parts are filtered out which have no relevance to the evaluation. Those image parts which are of interest for detection of an unauthorized object in the monitoring space are left. The non-changing image part of the at least one image can, for example, be filtered out in that the at least one video unit compares the at least one current image with at least one previously recorded image. For example, at least one suitable image, i.e. a reference image, in a memory unit, which is connected with the control unit by way of the communications network, can be used for that purpose. The memory unit can obviously also be integrated in the control unit.

The at least one video unit evaluates the at least one remaining image part. In that case it checks whether an object or an object of interest is located in the monitoring space. If an object is located in the monitoring space, then the at least one video unit transmits data to the control unit. For that purpose, the at least one video unit communicates as data, for example, the evaluation result or the evaluation result together with the remaining image part or only the remaining image part of the at least one image part or only the remaining image part of the at least one image to the control unit. The at least one video unit can thus cumulatively or alternatively transmit the remaining image part of the at least one image together with the evaluation result to the control unit.

The control unit checks, in dependence on the transmitted data, the authorization of the object located in the monitoring space and ascertains either the direction of movement or the location of the object within the monitoring space.

Through detection of the direction of movement or the location of the object it is possible to make a statement with regard to whether the object attempts to pass into a region of a building secured by the access monitoring device or whether the object, for example, is present merely in front of the access monitoring device. If the object does not have authorization for the secured region or if the authorization is denied then either a warning signal or alarm, for example an optical signal, an acoustic signal or a combination thereof, can be issued by way of a signalling unit or at least one message can be sent to a security center.

The access monitoring device can comprise at least two video units. In that case the at least one first video unit can be located in the viewing field of the at least one second video unit. Attempts at manipulation, for example by covering the video unit, can thus be avoided. Ideally, the at least one first video unit and the at least one second video unit are arranged oppositely. In the case of a double-door system or in the case of the access monitoring device the video units can then be arranged parallelly with or perpendicularly to the passageway direction. The at least one first video unit and the at least one second video unit can monitor the monitoring space from different viewing angles. The at least one first video unit can be directly connected with the at least one second video unit by way of the communications network or indirectly by way of the control unit.

The control unit can check the authorization either on the basis of at least one detection signal, which is transmitted by an authorization and authentication unit, or authorization and authentication information or signal or in accordance with at least one rule. In that case, any desired unit for detection or reading-in of the at least one detection signal can be used as an authorization and authentication unit, such as, for example, biometric data, a code consisting of numbers, letters, special characters or a combination thereof, a detection signal or authentication information or identification information stored on an RFID unit, an image, etc. Thus, for example, the at least one video unit according to the invention could be used for face recognition or for detection of biometric data and thus for authorization and authentication.

An advantage of the invention is to be seen in that an unauthorized object can be detected in a monitoring space of an access authorization device in simple and cost-effective mode and manner.

DESCRIPTION OF THE DRAWINGS

The invention is explained in more detail on the basis of an embodiment illustrated in the figures, in which.

DETAILED DESCRIPTION OF THE INVENTION

Figure 1:
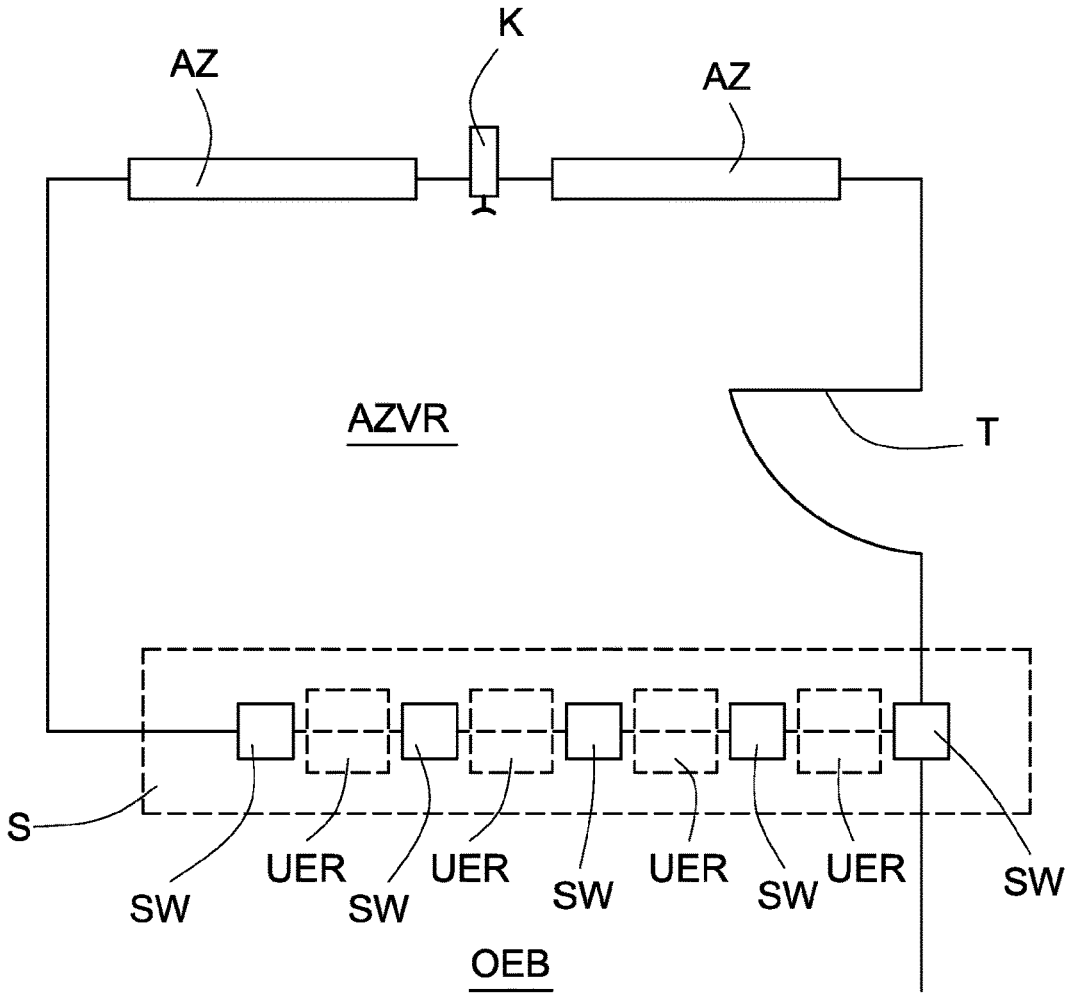
FIG. 1 shows a schematic illustration of a region secured by an access monitoring device.

FIG. 1 shows a schematic illustration of a region AZVR secured by an access monitoring device S, for example an elevator lobby as access to individual elevators AZ and to a door T in a building. The secured region AZVR is separated from the publicly accessible region OEB by the access monitoring device S. The access monitoring device S has boundaries SW, for example columns, double-door system walls, markings on the floor of the building, etc. In this example the access monitoring device S has several passages. However, the monitoring device S can also have only one passage. Moreover, the access monitoring device S comprises at least one video unit K or a video camera, which monitors at least one defined monitoring space UER of the access monitoring device S. The at least one video unit K is for this purpose arranged opposite the access monitoring device S. The at least one video unit K can also be arranged in the boundaries SW. Thus, the at least one video unit K could monitor a defined monitoring space between the boundaries SW.

In addition, the at least one video unit could also be arranged not permanently, but in accordance with need in the access monitoring device or at the access monitoring device. For example, at least one device and/or an appropriate interface for connection with the communications network and/or mounting/demounting the video unit could be provided at the access monitoring device S or at the boundaries SW.

Figure 2:
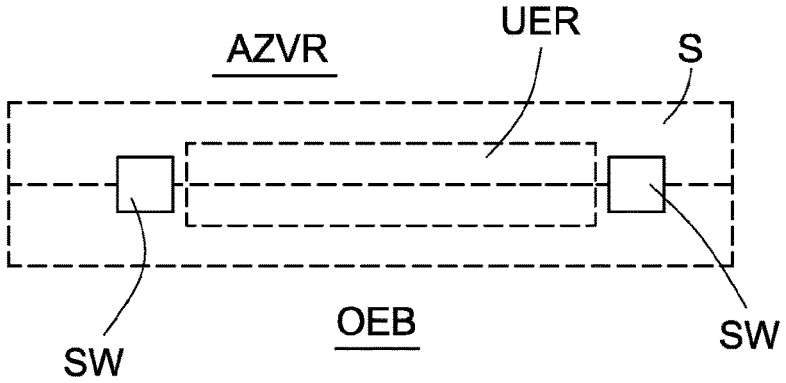
FIG. 2 shows a detail of the access monitoring device of FIG. 1.

FIG. 2 shows a detail of the access monitoring device S of FIG. 1. The access monitoring device S separates the publicly accessible region OEB of a building from a secured region AZVR or a non-publicly-accessible region. Boundaries SW of the access monitoring device S are used for separating the regions OEB and AZVR. Illustrated between the two boundaries SW is the monitoring space UER which is monitored by at least one video unit K (not illustrated in this figure).

Figure 3:
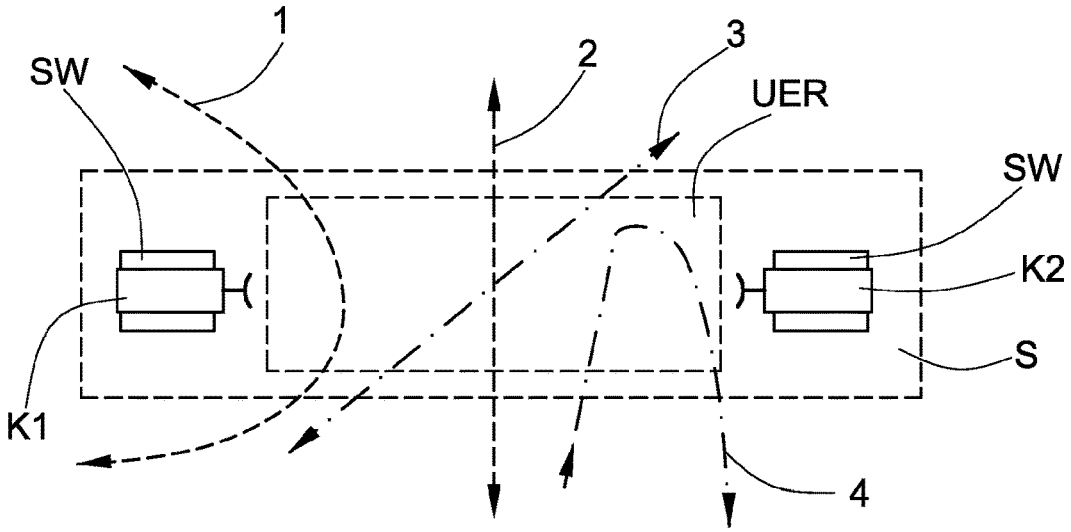
FIG. 3 shows a detail of an access monitoring device with possible directions of movement of an object.

FIG. 3 shows a detail of the access monitoring device S of FIGS. 1 and 2 with possible directions of movement of an object. The rectangle, which is illustrated in dashed lines, between the boundaries SW is to represent the monitoring space UER. In this example, two video units K1 and K2 are so arranged that they can detect the movements of objects such as, for example, persons, animals, etc., in the monitoring space UER. For that purpose the video units K1 and K2 are, in this example, integrated in the boundaries SW. Possible directions 1 to 4 of movement of objects moving in the secured region AZVR or out of the secured region AZVR are illustrated. The movement direction 4 can concern an object which attempts to pass into the secured region AZVR, but, for example, by means of a warning signal of at least one signalling device arranged in the boundaries SW has attention drawn to the fact that there is no authorization. Consequently, this object moves back out of the secured region AZVR.

Figure 4:
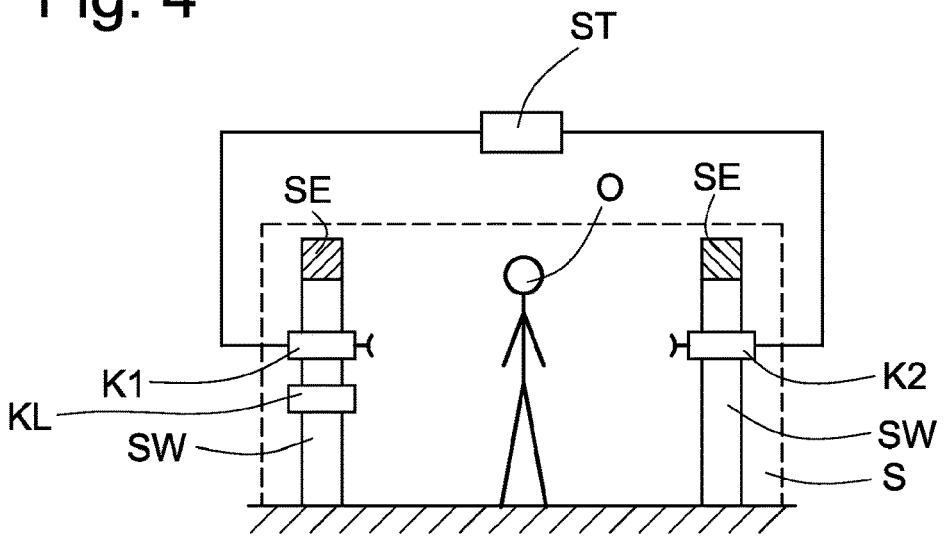
FIG. 4 shows a schematic illustration of an access monitoring device with two video units.

FIG. 4 shows a schematic illustration of an access monitoring device S with, for example, two video units K1 and K2. An object O is present between the boundaries SW of the access monitoring device S. The two video units K1 and K2 monitor the intermediate space, i.e. the defined monitoring space UER, between the two boundaries SW. In this example the first video unit K1 is located in the viewing field of the second video unit K2 and conversely. It is thus possible to prevent, for example, manipulation of a video unit K1 or K2. Integrated in the boundaries SW is a respective signalling unit SE which can issue at least an optical and/or acoustic signal when, for example, an object O is located in the monitoring space UER and this object O does not have authorization for that purpose, i.e. an authorization denial or a negative check result was ascertained by the control unit ST.

The two video units K1 and K2 are arranged oppositely and are connected with a control unit ST by way of a communications network. In that case, any desired communications network can be used as communications network. Thus, for example, use could be made of a wire-connected, a non-wire-connected and/or a radio communications network. The two video units K1 and K2 can also be connected by way of the communications network, whether directly or indirectly via the control unit ST.

Provision can be made for the two video units K1 and K2 to monitor the monitoring space UER from different viewing angles. In this example this takes place in that the two video units K1 and K2 are arranged oppositely. This has the advantage, for example, that the direction of movement or the location of an object O within the monitoring space UER can be determined more precisely. In addition, apart from the direction of movement or the location of the object O a video unit K, K1, K2 could also be so positioned that, for example, it authenticates or identifies the object O by means of facial recognition or recognition of biometric data.

The access monitoring device S can comprise an authorization and authentication unit KL. This unit (KL) can also be used for identification of an object O. The authorization and authentication unit KL detects at least one detection signal, for example a biometric signal, an item of authentication information stored on an RFID card, data for identification of an object, etc., and transmits the at least one detection signal in at least one message to the control unit ST. The at least one authorization and authentication unit KL can, as in this example, be arranged at the boundary SW of the access monitoring device S. It (KL) can, however, also be positioned at a different location or the functionality thereof can be looked after by the at least one video unit K, K1, K2. The control unit ST can, for example, check the authorization of an object O on the basis of a comparison with stored data. The evaluation of the detection or identification signal could obviously also take place in the authorization and authentication unit KL. The authorization can also be ascertained in dependence on at least one rule. Thus, for example, a rule could read that objects O which leave the secured region AZVR are granted authorization freedom. A further rule could read that authorization freedom always takes place at specific clock times. Yet another rule could read that in the case of no message from the authorization and authentication unit KL the control unit ST assumes authorization denial and issues a negative check result.

If an object O is located in within the defined monitoring space UER, the presence of the object O was detected by the two video units and the corresponding data or signals transmitted to the control unit ST and the control unit ST denies authorization for the object O, then a signalling unit SE connected with the control unit ST can issue a warning report. This warning report can consist of optical and/or acoustic signals. The control unit ST can, however, also transmit a message to a security center SZ, which is connected by way of the communications network, in the case of an authorization refusal or in the case of absent authorization. The security center SZ can in that case be, for example, a unit of a security center outside or inside the building. On receipt of the at least one message at the security center SZ appropriate measures can then be instituted such as, for example, a watchman is dispatched to the access monitoring device S, at least one of the video units K, K1, K2 records at least one further image of the object O, etc.

Figure 5:
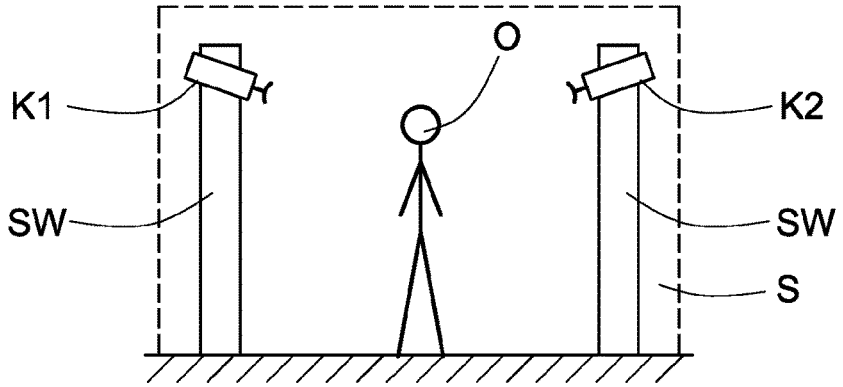
FIG. 5 shows a further schematic illustration of an access monitoring device with two video units and FIG. 6 shows a schematic example of image processing means with two video units.

FIG. 5 shows a further schematic illustration of an access monitoring device S with two video units K1, K2. The access monitoring device S is constructed as described in FIG. 4. The at least one authorization and authentication unit KL and the at least one signalling unit SE were omitted for reasons of clarity. The difference from FIG. 4 is that the two video units K1 and K2 are arranged differently from FIG. 4. The arrangement of the two video units K1 and K2 can, in principle, be as desired. It merely has to be ensured that the monitoring space UER can be monitored by the video units K1 and K2. This also applies when only one video unit K, K1, K2 is used.

Figure 6:
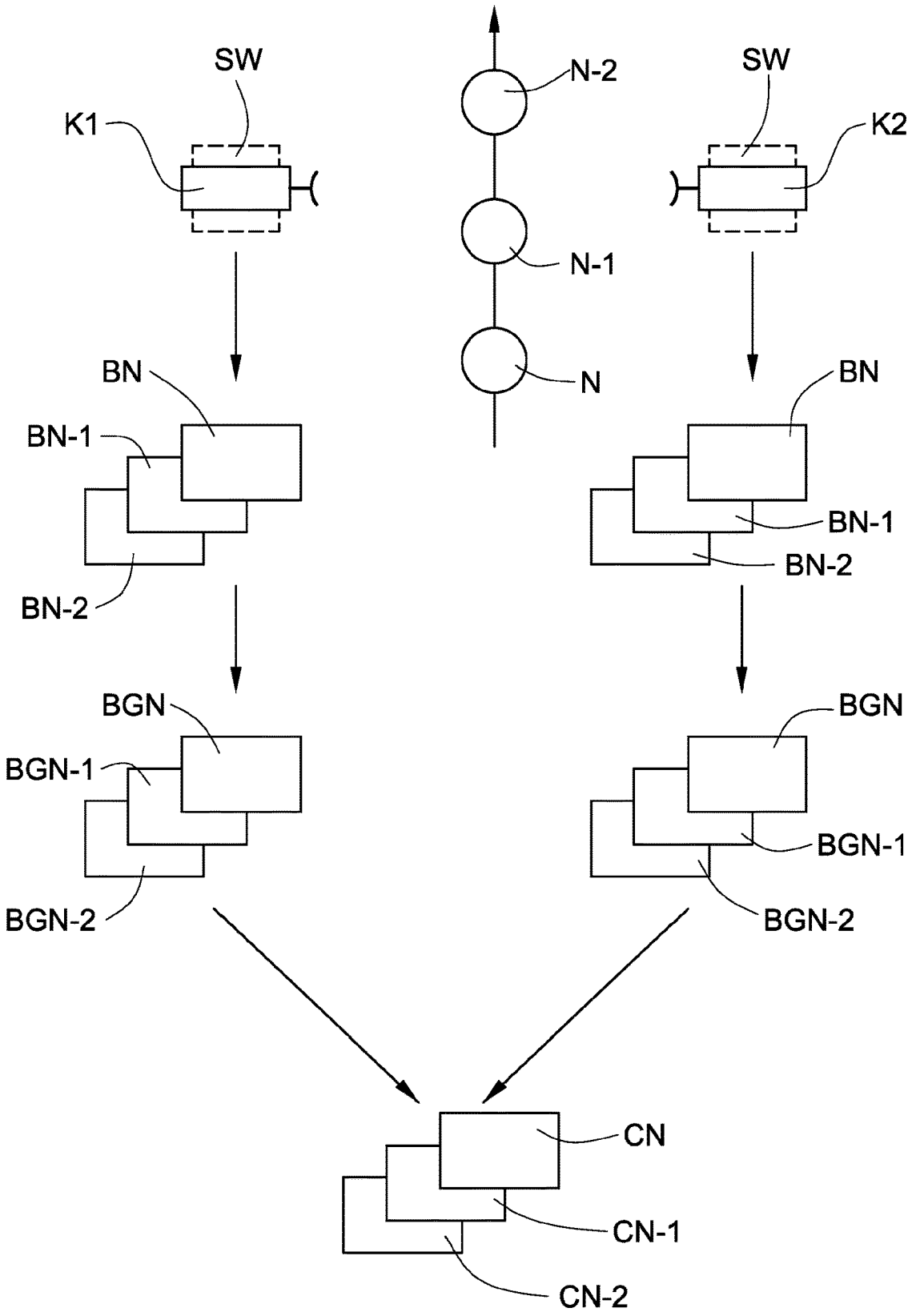

FIG. 6 shows a schematic example of image processing with two video units K1 and K2. The exemplifying method for the image processing can also be used analogously for access monitoring devices S with only one video unit K, K1, K2 or with more than two video units K, K1, K2.

Each of the two video units K1 and K2 records at a time interval N, N-1, N-2 or also continuously in this example a respective image BN, BN-1, BN-2. It is obviously conceivable for the two video units K1 and K2 to each record only one image BN.

Each of the two video units K1 and K2 filters out of the images BN, BN-1, BN-2 a respective non-changing image part. This non-changing image part can be, for example, the background.

The remaining image part BGN, BGN-1, BGN-2 of the respective images BN, BN-1, BN-2 is evaluated with regard to whether an object O is located in the monitoring space UER. An object O in that case passes through the access monitoring device S with the boundaries SW and the video units K1 and K2, as it (S) is described in FIGS. 1 to 5. Preferably, in the case of the object O being located in the monitoring space UER data are transmitted to the control unit ST. As data, use can be made, for example, of the evaluation result or the evaluation result and the remaining image parts BGN, BGN-1, BGN-2 of the image BN, BN-1, BN-2 or only the remaining image parts BGN, BGN-1, BGN-2 of the images BN, BN-1, BN-2 or the images BN, BN-1, BN-2, etc. It is obviously also conceivable for the entire image BN, BN-1, BN-2 to be transmitted to the control unit ST and the entire evaluation to take place there, i.e. the unchanging image part is filtered out by the control unit ST and detection of an object O in the monitoring space UER is also carried out by the control unit ST.

The transmission of the data, thus of the evaluation result and/or the remaining image part BGN, BGN-1, BGN-2, takes place, as already mentioned, ideally only when an object O was actually detected in the monitoring space UER. In the case of a negative evaluation result, i.e. no object O is present in the monitoring space UER, no transmission could take place. Obviously, it is equally conceivable for the image parts BGN, BGN-1, BGN-2 or the entire images BN, BN-1, BN-2 to be transmitted to the control unit ST independently of the evaluation result.

The control unit ST checks, in dependence on the transmitted data of the two video units K1, K2, the authorization of the object located in the monitoring space UER. It is thus checked whether an object O is located in the monitoring space UER and, if so, the authorization of the object O concerned is then checked by the control unit ST. The authorization check is carried out either on the basis of data from an authorization and authentication unit KL or according to at least one rule as described in the preceding FIGS.

1 to 5. The direction of movement or the clock time could be applicable, for example, as the at least one rule. It could thus be ruled that if an object O goes out of the secured region AZVR no authorization is required. In addition, no authorization could be required at specific clock times.

The direction 1, 2, 3, 4 of movement or the location—for example the object O could be in the monitoring space UER—of the object O within the monitoring space UER is detected in dependence on the evaluation results and/or the respective remaining image parts BGN, BGN-1, BGN-2 of the two video units K1 and K2. This can happen, for example, in that transmitted remaining image parts BGN, BGN-1, BGN-2 are combined and/or compared by the control unit ST and/or that on the basis of the remaining image parts of a video unit K1 or K2 determination of the direction of movement or the location of the object O is carried out. In addition, the evaluation result could also be utilized for determining the direction of movement or the location of the object O. In this example the remaining image parts BGN, BGN-1, BGN-2 of the two video units K1 and K2 are combined together and combined, remaining image parts CN, CN-1, CN-2 result. Depending on the combined remaining image parts CN, CN-1, CN-2 the authorization can be checked and the direction of movement or the location of the object O determined by the control unit ST.

The control unit ST could, with use of the determined direction of movement or the location and an absent authorization of the object O or an ascertained authorization denial by the control unit ST, transmit at least one message to a security center SZ, which could then execute suitable measures, for example dispatch of a watchman, recording of an image, blocking of the elevator AZ, closing or locking of the door T, etc. In addition, a signalling unit SE could issue a warning report, i.e. at least one optical and/or acoustic signal. As signalling unit SE use could be made of a unit which issues light and/or a tone or tone sequences. In addition, the optical signals could be pictograms, images, etc. The signalling unit SE can be integrated in the boundary SW or represent a separate unit. One possible positioning variant is illustrated, for example, in FIG. 1.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An access monitoring device for an elevator installation, the elevator installation including a publicly accessible region, an elevator and a secured region providing access to the elevator from the publicly accessible region, the secured region being separated from the publicly accessible region by the access monitoring device, the access monitoring device comprising:

a pair of spaced apart boundaries separating the publicly accessible region from the secured region and a defined monitoring space located between the boundaries wherein the elevator is accessible to an object only by the object passing from the publicly accessible region through the monitoring space to the secured region and through the secured region to the elevator;

a first video unit and a second video unit arranged to record images of the monitoring space and generate data related to the images, the data being one or more of associated remaining image parts generated by the first video unit and the second video unit filtering out an unchanging image part of each of the images, an evaluation of the remaining image parts generated by the at least one video unit, and the images, wherein the first video unit is located in a viewing field of the second video unit and is viewable by the second video unit, and the second video unit is located in a viewing field of the first video unit and is viewable by the first video unit to prevent manipulation of the first and second video units;

a control unit connected to the first video unit and the second video unit for receiving the data and combining the data from the first video unit and the second video unit to form combined remaining image parts, the control unit generating any of the associated image parts not generated by the at least one video unit and generating the evaluation if not generated by the at least one video unit;

wherein depending on the combined remaining image parts, the control unit checks, in dependence on the evaluation, whether the object is present in the monitoring space and, if so, whether the object is authorized to access the secured region, the checking of the authorization being based on at least one rule or on an authorization message;

an authorization and authentication unit connected to the control unit for generating the authorization message in response to receiving a detection signal associated with the object; and a signaling unit at the boundaries and connected to the control unit for issuing a warning signal in response to the control unit denying authorization for the object when the object is not authorized to access the secured region.

2. The access monitoring device according to claim 1 wherein the first video unit and the second video unit are arranged opposite one another.

3. The access monitoring device according to claim 1 wherein the at least one rule is authorization if the object leaves the secured region, authorization for the object at a specified time, or deny authorization if the authorization and authentication unit does not generate the authorization message.

4. The access monitoring device according to claim 1 wherein the detection signal associated with the object includes at least one of a code, a biometric signal and a signal stored on an RFID card.

5. The access monitoring device according to claim 1 wherein warning signal is at least one of an optical signal and an acoustic signal.

6. The access monitoring device according to claim 1 wherein the control unit responds to denying authorization or an absence of the authorization message by transmitting at least one message to a security unit connected to the control unit by a communications network.

7. The access monitoring device according to claim 1 wherein the first video unit and the second video unit filter out the unchanging image part of the images by comparing each of the images with at least one previously recorded image.

8. The access monitoring device according to claim 1 including at least three of the boundaries defining at least two of the monitoring space and wherein the first video unit and the second video unit record images from each of the monitoring spaces.

9. The access monitoring device according to claim 1 wherein each of the boundaries includes a member selected from a group consisting of a column, a double-door system wall, and a marking on a floor.

10. The access monitoring device according to claim 1 wherein the control unit responds to denying authorization or an absence of the authorization message by transmitting at least one message to a security unit connected to the control unit by a communications network, and wherein the security unit is configured to block the elevator, close a door of the elevator installation, or lock a door of the elevator installation.

11. The access monitoring device according to claim 1 wherein the secured region is an elevator lobby including a plurality of elevators, the boundaries define a passageway between the elevator lobby and the publicly accessible region, and the signaling unit is integrated in at least one of the boundaries.

12. The access monitoring device according to claim 1 wherein the first video unit and the second video unit are arranged opposite to the monitoring space and view the monitoring space across at least a portion of the secured region.

13. An elevator installation comprising:

a publicly accessible region;

a secured region being an elevator lobby including access to at least two elevators of the elevator installation;

at least two boundaries defining a passageway between the secured region and the publicly accessible region;

a monitoring space positioned in the passageway, the at least two elevators being accessible to an object only by the object passing from the publicly accessible region through the defined monitoring space to the secured region and then through the secured region to the at least two elevators;

an access monitoring device including a first video unit and a second video unit, a control unit connected to the first video unit and the second video unit, an authorization and authentication unit connected to the control unit, and a signaling unit at the boundaries and connected to the control unit, the secured region being separated from the publicly accessible region by the access monitoring device, wherein the first video unit is located in a viewing field of the second video unit and is viewable by the second video unit, and the second video unit is located in a viewing field of the first video unit and is viewable by the first video unit to prevent manipulation of the first and second video units;

wherein the first video unit and the second video unit record images of the monitoring space and send data related to the images to the control unit, the control unit receiving the data and combining the data from the first video unit and the second video unit to form combined data;

wherein the control unit checks, in dependence on the combined data and an evaluation of remaining image parts generated by filtering out an unchanging image part of each of the images, whether the object is present in the monitoring space and, if so, whether the object is authorized to access the secured region, the checking of the authorization being based on at least one rule or on an authorization message;

wherein the authorization and authentication unit generates the authorization message in response to receiving a detection signal associated with the object; and wherein the signaling unit issues a warning signal in response to the control unit denying authorization for the object in the monitoring space when the object is not authorized to access the secured region.

14. A method for detection of an object in a monitoring space between boundaries of an access monitoring device separating a publicly accessible region from a secured region of an elevator installation, the method comprising the steps of:

providing a first video unit and a second video unit arranged to record images of the monitoring space and being connected with a control unit, wherein the first video unit is located in a viewing field of the second video unit and is viewable by the second video unit, and the second video unit is located in a viewing field of the first video unit and is viewable by the first video unit to prevent manipulation of the first and second video units;

recording with the first video unit and the second video unit images of the monitoring space and generating data related to the images to the control unit, the data being one or more of an associated remaining image part generated by the at least one video unit filtering out an unchanging image part of each of the images, an evaluation of the remaining image parts generated by the at least one video unit, and the images;

using the control unit to combine the remaining image parts from the first video unit and the second video unit to form combined remaining image parts;

checking with the control unit, in dependence on the evaluation of the combined remaining image parts, to determine whether the object is present in the monitoring space and, if so, whether the object is authorized to access the secured region, the checking of the authorization being based on at least one rule or on an authorization message;

providing an authorization and authentication unit connected to the control unit and generating the authorization message from the authorization and authentication unit in response to receiving a detection signal associated with the object; and providing a signaling unit at the boundary and connected to the control unit and issuing a warning signal from the signaling unit in response to the control unit denying authorization for the object in the monitoring space when the object is not authorized to access the secured region.

* * * * *